US007747209B2

(12) United States Patent
Yamazaki et al.

(10) Patent No.: US 7,747,209 B2
(45) Date of Patent: Jun. 29, 2010

(54) PRINTING APPARATUS

(75) Inventors: Akihiko Yamazaki, Ibaraki (JP); Isao Nakajima, Ibaraki (JP); Sho Sawahata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 1007 days.

(21) Appl. No.: 11/322,305

(22) Filed: Jan. 3, 2006

(65) Prior Publication Data

US 2006/0188304 A1 Aug. 24, 2006

(30) Foreign Application Priority Data

Feb. 18, 2005 (JP) ..... P2005-042196
Sep. 22, 2005 (JP) ..... P2005-275370

(51) Int. Cl.
*G03G 15/00* (2006.01)

(52) U.S. Cl. ..... 399/384; 399/388; 403/294; 312/110; 312/199; 312/200; 312/201; 312/202; 312/203; 70/389

(58) Field of Classification Search ..... 399/384, 399/110, 388; 70/389; 312/110, 199, 200, 312/201, 202, 203; 403/294
See application file for complete search history.

(56) References Cited

U.S. PATENT DOCUMENTS 5,729,817 A * 3/1998 Raymond et al. ..... 399/384
6,308,026 B1 * 10/2001 Kouchi ..... 399/110
6,679,646 B2 * 1/2004 Quardt et al. ..... 403/348
2003/0103779 A1 * 6/2003 Yokoyama ..... 399/122
2004/0060210 A1 * 4/2004 Nishimura et al. ..... 37/465
2005/0232670 A1 * 10/2005 Otome et al. ..... 399/384

FOREIGN PATENT DOCUMENTS

JP 58-100343 7/1983
JP 2894889 3/1999
JP 11-168284 8/1999

OTHER PUBLICATIONS

"Antique Key" Jan. 18, 2005, http://flickr.com/photos/22434330@N00/3526119.*

* cited by examiner

*Primary Examiner*—Judy Nguyen
*Assistant Examiner*—Andy L Pham
(74) *Attorney, Agent, or Firm*—McGinn IP Law Group, PLLC

(57) ABSTRACT

A printing apparatus including a first component having a photosensitive member and a transcribing portion transcribing a toner image formed on the photosensitive member onto a web, and a second component having a web guide portion guiding the web transported to the transcribing portion and a fixing portion fixing the toner image transcribed onto the web, the first component and the second component being able to be connected/divided, the first component is provided with a transcribing portion base supporting the transcribing portion, the second component is provided with a web guide portion base arranged at a position opposed to the transcribing portion base supporting the web guide portion, and an adjusting member for restricting a position of the second component relative to the first component is provided between the transcribing portion base and the web guide portion base.

20 Claims, 4 Drawing Sheets

PRINTING APPARATUS

BACKGROUND OF THE INVENTION

1. Field of the Invention

The present invention relates to a printing apparatus, particularly relates to a printing apparatus having a structure capable of being divided into a plurality of components.

2. Description of the Related Art

In accordance with correspondence to multicolor print or correspondence to large capacity of a recording medium, a printing apparatus causes size increase.

In case that the printing apparatus exceeds a common volume by the size increase, the printing apparatus is restricted by a width and a height of a door, a passage, an elevator or the like at an installing location. Therefore reconstruction of a building for installing the printing apparatus is needed. Also, in the case that the printing apparatus exceeds a common weight by the size increase, transporting means is limited and a number of persons are needed for operation of moving the printing apparatus.

Accordingly, a large printing apparatus is carried in to an installing location in the divided style a plurality of components, and the components are integrated at the installing location.

SUMMARY OF THE INVENTION

JP-UM-A-58-100343 discloses the large printing apparatus that be able to divide into a plurality of components. However, positioning accuracy of JP-UM-A-58100343 is relatively coarse, therefore, it is not usable to a printing apparatus which requires high accuracy of 1 mm or less for positioning of the components such as a color printing apparatus.

According to an aspect of the invention, there is provided a printing apparatus including: a first component having a photosensitive member, a transcribing portion transcribing a toner image formed on the photosensitive member to a web, and a transcribing portion base supporting the transcribing portion; and a second component having a web guide portion guiding the web transported to the transcribing portion, a fixing portion fixing the toner image transcribed to the web; and a web guide portion base being arranged at a position opposed to the transcribing portion base, the web guide portion base supporting the web guide portion. The first and second components are able to be connected and divided. An adjusting member restricting a position of the second component relative to the first component is provided between the transcribing portion base and the web guide portion base.

According to the above-aspect, there is provided the printing apparatus capable of accurately connecting the divided components at a predetermined position.

BRIEF DESCRIPTION OF THE DRAWINGS

These and other objects and advantages of this invention will become more fully apparent from the following detailed description taken with the accompanying drawings in which:

FIG. 7 illustrates explanatory views of an adjusting member.

DESCRIPTION OF THE PREFERRED EMBODIMENTS

An embodiment of the invention will be explained in reference to the drawings as follows.

Figure 1:
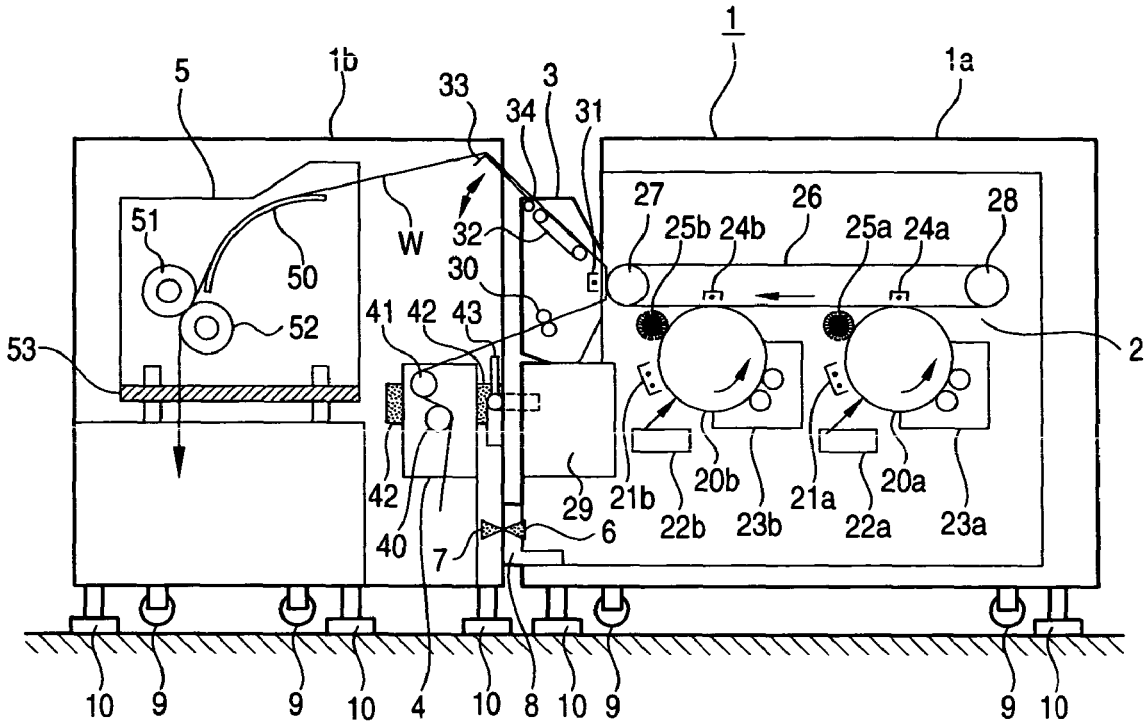
FIG. 1 is a front view of a printing apparatus according to an embodiment.

First, a total construction of a printing apparatus of the embodiment will be explained in reference to FIG. 1 by exemplifying a color laser printer. Although FIG. 1 shows a printer having two photosensitive drums in order to simplify the explanation, a full color printer using cyan, magenta, yellow and black is mounted with four of photosensitive drums. The embodiment is not limited to a color printer, and it may be a monochromatic printer mounted with a single photosensitive drum.

In FIG. 1, numeral 1 designates a laser printer which is constituted by connecting a first component 1*a* (hereinafter, referred to as printing component 1*a*)and a second component 1*b* (hereinafter, referred to as fixing component 1*b*.

The printing component 1*a* is mainly provided with an image forming portion 2 and a transcribing portion 3. The fixing component 1*b* is mainly provided with a web guide portion 4 and a fixing portion 5.

The image forming portion 2 is provided with photosensitive drums 20*a*, 20*b*, charging devices 21*a*, 21*b*, exposing device 22*a*, 22*b*, developing devices 23*a*, 23*b*, primary transcribing devices 24*a*, 24*b*, cleaning devices 25*a*, 25*b* and an intermediate transcribing belt 26.

The photosensitive drums 20*a*, 20*b* start rotating in arrow mark directions based on a print start signal from a controller (not illustrated). The photosensitive drums 20*a*, 20*b* rotate at a speed in correspondence with a printing speed of the laser printer 1 and continue to rotate until a printing operation is finished.

When the photosensitive drums 20*a*, 20*b* start rotating, a high voltage is applied on the charging devices 21*a*, 21*b*. Surfaces of the photosensitive drums 20*a*, 20*b* are uniformly charged by the charging devices 21*a*, 21*b*.

Light is irradiated from the exposing device 22*a*, 22*b* having semiconductor lasers or light emitting diodes as light source. Irradiated light exposes the photosensitive drums 20*a*, 20*b* to form an electrostatic latent image on the photosensitive drums 20*a*, 20*b*. When regions of the photosensitive drums 20*a*, 20*b* holding the electrostatic latent images reach positions where the developing devices 23*a*, 23*b* is opposed to, a developing agent is supplied to the electrostatic latent images. And toner images are formed on the photosensitive drums 20*a*, 20*b* by the developing agent.

The toner images formed on the photosensitive drums 20*a*, 20*b* are primarily transcribed onto the intermediate transcribing belt 26 by operating the primary transcribing devices 24*a*, 24*b*. The intermediate transcribing belt 26 is supported by a drive roller 27 and a driven roller 28 movably in an arrow mark direction to deliver the toner images transcribed from the photosensitive drums 20*a*, 20*b* to a side of the transcribing portion 3.

The transcribing portion 3 is installed on a transcribing portion base 29 and is provided with a pair of sheet transporting roller 30, a secondary transcribing device 31, a sheet transporting belt 32 and a buffer plate 33.

The printer of the embodiment is a printer for printing a web (normally, continuous sheet is used) which is continuously carried, and the web W is supplied from a sheet hopper (not illustrated) provided at inside of the printer, or a sheet supply apparatus (not illustrated) installed outside of the printer.

The web W is transported to between the intermediate transcribing belt 26 and the secondary transcribing device 31 by the pair of sheet transporting roller 30 via the web guide portion 4 (details of which will be described later) provided at the fixing component 1*b* in synchronism with timings at which the toner images formed at the intermediate transcribing belt 26 reach a secondary transcribing position.

The toner images formed on the intermediate transcribing belt 26 are secondarily transcribed onto the web W by operating the secondary-transcribing device 31.

The toner images transcribed onto the web W have not been finished to fix and therefore, it is not pertinent to use a transporting member transporting the web in contact with an image face. The web W which has passed through the secondary transcribing device 31 is transported by the sheet transporting belt 32 transporting the sheet while sucking a sheet face on a side opposed to the image face by air.

In this way, the web W is transported to the fixing portion 5 via the pair of sheet transporting roller 30, the secondary transcriber 31, the sheet transporting belt 32 and the buffer plate 33.

In the fixing component 1*b*, the web guide portion 4 is provided with rotating rollers 40, 41 to form a web transporting path in a substantially S-like shape. The rotating rollers 40, 41 are driven to rotate by friction with the web W drawn by the pair of sheet transporting roller 30. The web W is exerted with a predetermined tension by the web carrying path in the substantially S-like shape.

The web guide portion 4 is supported by a web guide portion base 42 provided at the fixing component 1*b* at a position opposed to the transcribing base 29. A portion of the web guide portion base 42 opposed to the transcribing portion base 29 is provided with an adjusting member 43 (details of which will be described later) which is used for connecting the printing component 1*a* and the fixing component 1*b*.

The fixing portion 5 is provided with a web guide 50, a heating roller 51 and a pressing roller 52. The fixing portion 5 is installed on a fixing portion base 53 provided at the fixing component 1*b*.

The web W transported to the fixing portion 5 is guided to a nip portion by the web guide 50. The nip portion is formed by the heating roller 51 and the pressing roller 52. The web W is nipped to be transported by the nip portion while being heated and pressed to fix the toner images onto the web W. In addition, the web guide 50 can constitute a pre-heater including a heat source that heats the web W before the nip portion.

The web W transported by the heating roller 51 and the pressing roller 52 is discharged to a sheet discharging portion provided at inside of the printer, or discharged to a post processing apparatus (not illustrated) arranged at a post stage of the printer.

The photosensitive drums 20*a*, 20*b* passing through the primary transcribing devices 24*a*, 24*b* are cleaned by the cleaning devices 25*a*, 25*b*, also the intermediate transcribing belt 26 passing through the secondary transcribing device 31 is cleaned by a cleaning device (not illustrated) for the next print operation.

In FIG. 1, numerals 6 and 7 designate marks used for adjusting heights, which are respectively provided at the printing component 1*a* and the fixing component 1*b*. Numeral 8 designates a block member formed in a substantially L-like shape positioning a position of confronting the printing component 1*a* and the fixing component 1*b* and is provided at a lower portion of the printing component 1*a*.

Numeral 9 designates a caster provided at a bottom face of each of the components 1*a*, 1*b* and numeral 10 designates a jack provided to be able to adjust the height.

The buffer plate 33 provided at the printing component 1*a* absorbs slack or excess tension of the web W which are caused by a difference between speeds of the sheet transporting belt 32 and the fixing rollers 51, 52. The buffer plate 33 is provided pivotably in an arrow mark direction by a shaft 34, and the buffer plate is pressed toward the web by an elastic member (not illustrated).

In the case that the above-described printer is configured by a single member, a volume and a weight thereof transported by one time are increased and is restricted by transporting member or the like. Hence, according to the embodiment, after finishing adjustment and inspection at a fabricating factory, the printer is temporarily divided into the printing component 1*a* and the fixing component 1*b*. The printing component 1*a* and the fixing component 1*b* are connected again after having been carried to a site (installing location of a customer).

According to the printer for forming the toner images on continuous sheet in the web-like shape, a positional relationship between the web guide portion 4 and the transcribing portion 3 and a positional relationship between the transcribing portion 3 and the fixing portion 5 are extremely important. When the three members are not positioned accurately, a sheet transporting failure, a transcribing failure and a fixing failure are brought about.

A method of connecting the printing component 1*a* and the fixing component 1*b* will be explained as follows.

Figure 2:
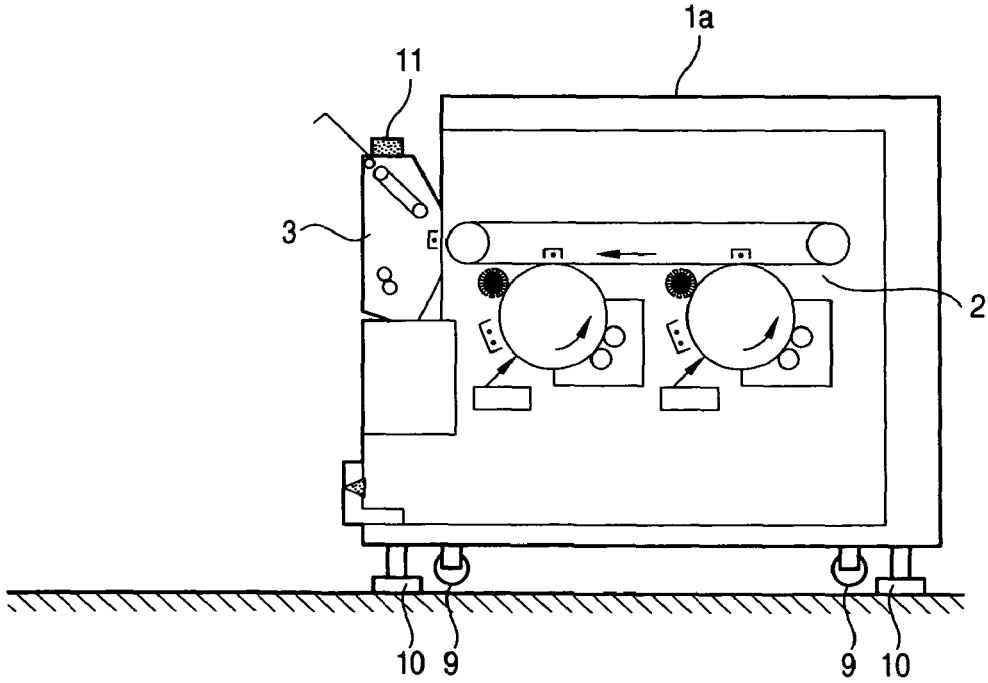
FIG. 2 is a front view of a first component.

An installing operation at the site is carried out first from the printing component 1*a*. In installing the printing component 1*a*, as shown by FIG. 2, a leveler 11 is mounted on the transcribing portion 3, and a horizontal level of the printing component 1*a* is set by adjusting the height of the jack 10 provided at the printing component 1*a*.

Figure 3:
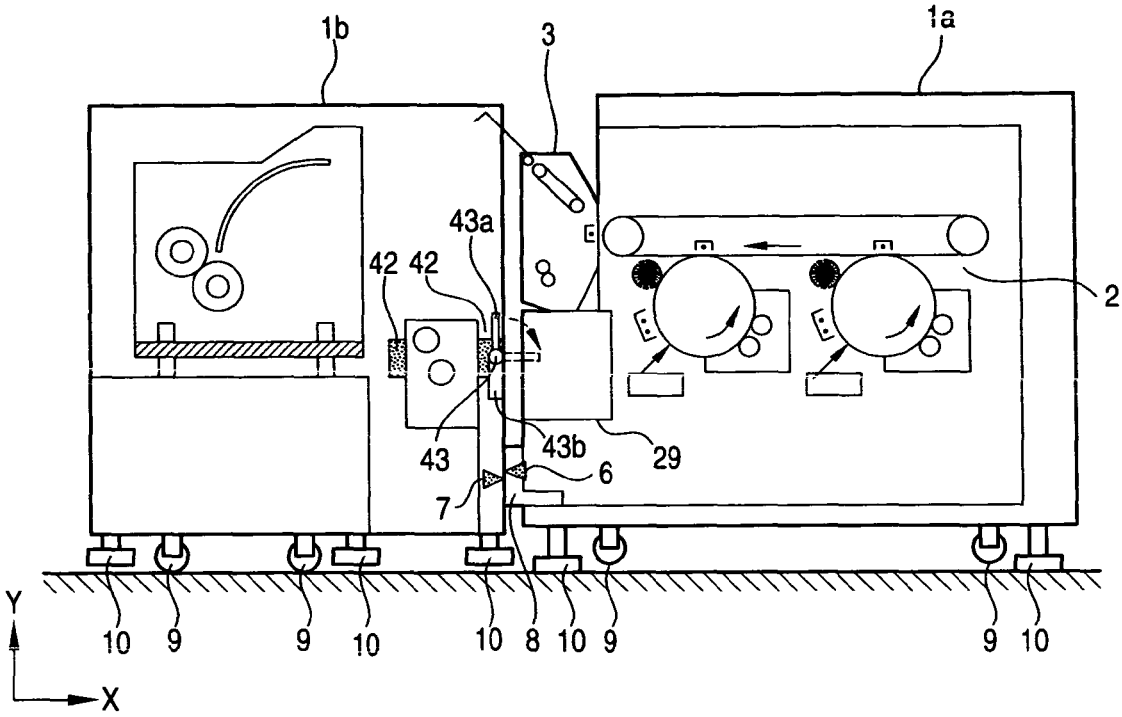
FIG. 3 is a front view showing a state of confronting a second component with the first component.

Next, as shown by FIG. 3, positioning in X direction is carried out by confronting the fixing component 1*b* to a vertical face of the block member 8 of the printing component 1*a*.

Figure 7A:
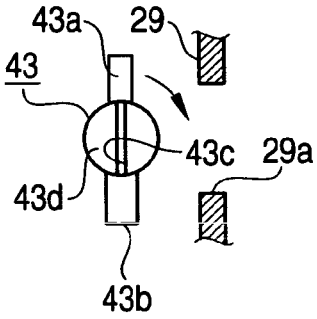
FIGS. 7A and 7B are outline side views.
Figure 7B:
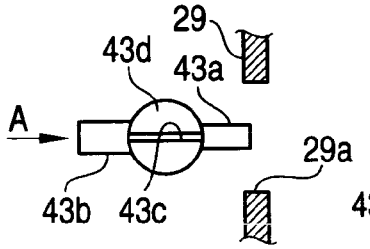
Figure 7C:
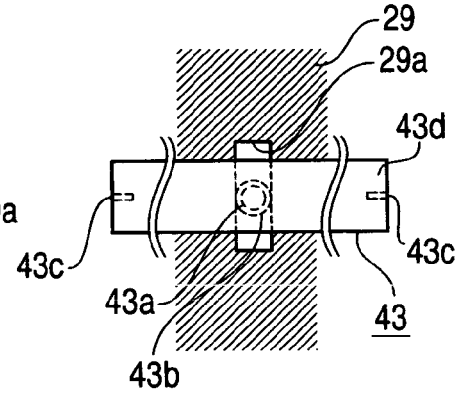
FIG. 7C is a view viewing in A direction arrow mark of FIG. 7B.

In this state, a rough adjusting pin 43*a* of the adjusting member 43 provided at the web guide portion base 42 is moved to a broken line position and engaged with a opening 29*a* (refer to FIGS. 7A-7C) to position in Z direction (direction orthogonal to paper face in FIG. 3). The web guide portion base 42 and the transcribing portion base 29 are frames for ensuring rigidities of the respective components.

As shown by FIG. 7, the adjusting member 43 is provided with the rough adjusting pin 43*a* and a fine adjusting pin 43*b* projected from an outer periphery of a rotating shaft 43*d* and in which the rough adjusting pin 43*a* or the fine adjusting pin 43*b* can be engaged with the opening 29*a* provided at the transcribing portion base 29 by inserting the end of a tool of a screw driver or the like into a groove 43*c* provided at a side face of the rotating shaft 43*d*. According to the embodiment, a width of the opening 29*a* is 14 mm, an outer diameter of the rough adjusting pin 43*a* is 10 mm and an outer diameter of the fine adjusting pin 43*b* is 13.9 mm.

Figure 4:
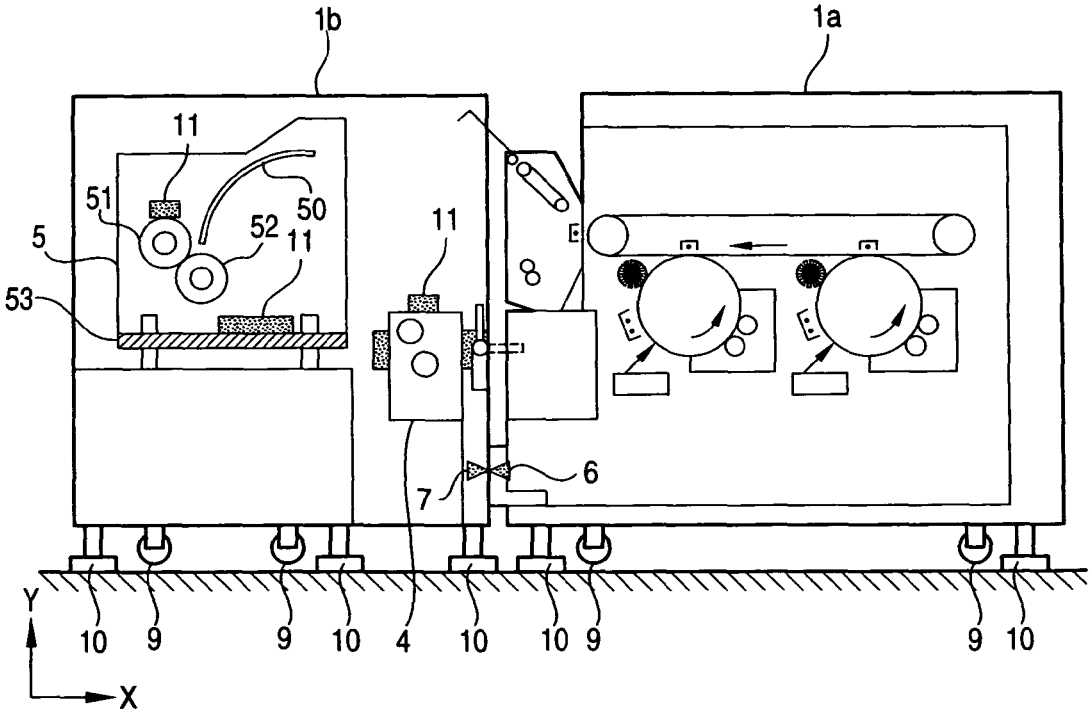
FIG. 4 is a front view showing a rough adjusting state of the first component and the second component.

Positioning in Y direction of the fixing component 1*b* confronted to the printing component 1*a* is carried out by adjusting the jack 10 of the fixing component 1*b* such that the positioning mark 7 provided at the fixing member 1*b* matches with the positioning mark 6 provided at the printing component 1*a* as shown by FIG. 4. The horizontal level is set by mounting the leveler 11 on the web guide portion 4, the fixing rollers 51, 52 and the fixing portion base 53 in combination with adjustment by the jack. Further, the levelers 11 of FIG. 4 are not necessarily three levelers simultaneously, and normally, the single leveler is used by pertinently installing the leveler at necessary-portions.

Although the components are finished to be connected by installing the printing component 1*a* and the fixing component 1*b*, with regard to positions of the transcribing portion 3, the web guide portion 4 and the fixing portion 5 relative to each other according to the embodiment, a positional shift allowable tolerance is 0.5 mm through 1 mm, and there is a case in which the positional shift cannot be restrained in the allowable range by positioning by the jack 10 and the level 11.

Figure 5:
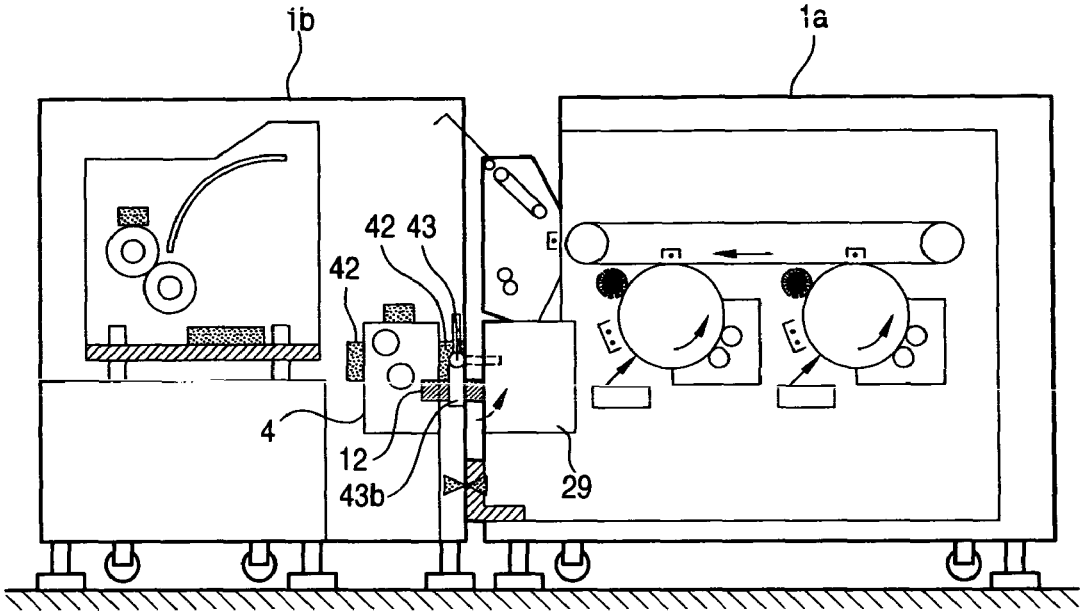
FIG. 5 is a front view showing a fine adjusting state of the first component and the second component.

Hence, when finer adjustment is needed, after enabling to move the web guide portion 4 by loosening the web guide portion 4 from being fixed to the web guide portion base 42, as shown by FIG. 5, the fine adjusting pin 43*b* of the adjusting member 43 is moved to a broken line position to engage the fine adjusting pin 44*b* to the opening 29*a* to thereby carry out fine adjustment of the transcribing portion 3 and the web guide portion 4 in Z direction (direction orthogonal to paper face in FIG. 5).

Figure 8:
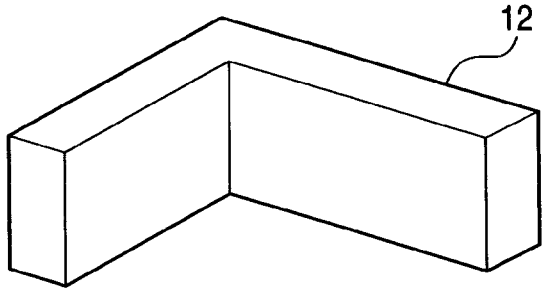
FIG. 8 is a perspective view of a total of an adjusting block.

Further, by positioning by interposing the adjusting block 12 between the web guide portion base 42 and the transcribing portion base 29, highly accurate positioning can be carried out. As shown by FIG. 8, the adjusting block 12 is a block member made of aluminum constituting the L-like shape, two pieces of the adjusting blocks 12 are prepared and when positioning operation, the adjusting blocks 12 are arranged at both end portions in a longitudinal direction of the web guide portion base 42.

Figure 6:
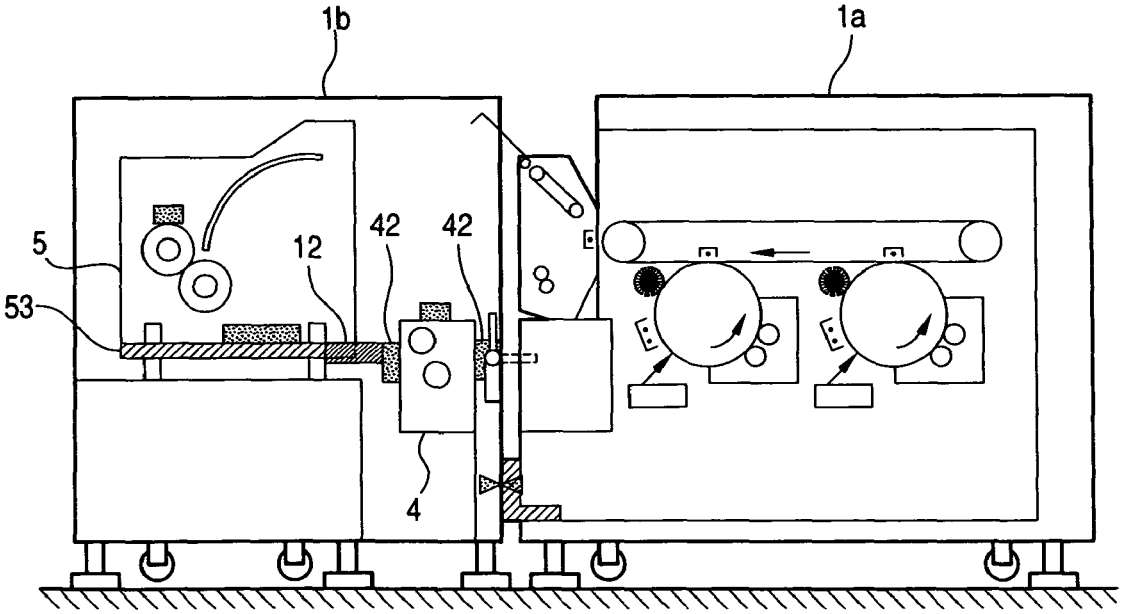
FIG. 6 is a front view showing a fine adjusting state of the first component and the second component.

As shown by FIG. 6, the adjusting block 12 maybe installed between the web guide portion base 42 and the fixing portion base 53 to be used for fine adjustment of the fixing portion 5. Further, use of the adjusting block 12 is not indispensable, and there may be constructed a constitution of directly confronting the web guide portion base 42 and the transcribing portion base 29, or the web guide portion base 42 and the fixing 12 portion base 53 to position.

What is claimed is:

1. A printing apparatus, comprising:

a first component having a photosensitive member, a transcribing portion transcribing a toner image formed at the photosensitive member onto a web, and a transcribing portion base supporting the transcribing portion;

a second component having a web guide portion guiding the web transported to the transcribing portion, a fixing portion fixing the toner image transcribed onto the web to the web; and a web guide portion base being arranged at a position opposed to the transcribing portion base, the web guide portion base supporting the web guide portion, wherein the first and second components are able to be connected and divided, wherein an adjusting member restricting a position of the second component relative to the first component is provided between the transcribing portion base and the web guide portion base, wherein the adjusting member includes a pivotable pin member supported by one of the transcribing portion base and the web guide portion base, said pivotable pin member comprising:

a first pin for a first type of adjustment; and a second pin for a second type of adjustment, different from the first type of adjustment based on an amount of said restricting the position of the second component relative to the first component, wherein a rotating shaft connects said first pin to the second pin, said rotating shaft comprising a groove at a side face for receiving a driver to engage one of the first pin and the second pin with an opening provided at an other one of the transcribing portion base and the web guide portion base.

2. The printing apparatus according to claim 1, wherein the adjusting member restricts a position in a direction perpendicular to a direction of connection of the second component to the first component.

3. The printing apparatus according to claim 1, wherein the first pin has an outer diameter engageable with the opening, and wherein a second pin has an outer diameter engageable with the opening and an outer diameter larger than the outer diameter of the first pin.

4. The printing apparatus according to claim 1, wherein the photosensitive member comprises one of a plurality of the photosensitive members.

5. The printing apparatus according to claim 1, wherein an intermediate transcribing member is provided between the photosensitive member and the transcribing portion.

6. The printing apparatus according to claim 1, wherein the web guide portion comprises a tension exerting portion for exerting a tension to the web transported to the transcribing portion.

7. A printing apparatus comprising:

a first component having a plurality of photosensitive members, a transcribing portion transcribing a toner image formed on photosensitive members onto a web, and a transcribing portion base for supporting the transcribing portion; and a second component having a web guide portion guiding the web transported to the transcribing portion, a fixing portion fixing the toner image transcribed onto the web to the web, and a web guide portion base arranged at a position opposed to the transcribing portion base for supporting the web guide portion, wherein the first component and the second component are able to be connected and divided, wherein an adjusting member for restricting a position in a direction perpendicular to a direction of connection of the second component to the first component is provided between the transcribing portion base and the web guide portion base, wherein the adjusting member includes a pivotable pin member supported by one of the transcribing portion base and the web guide portion base, said pivotable pin member comprising:

a first pin for a first type of adjustment; and a second pin for a second type of adjustment, different from the first type of adjustment based on an amount of said restricting the position of the second component relative to the first component, wherein a rotating shaft connects said first pin to the second pin, said rotating shaft comprising a groove at a side face for receiving a driver to engage one of the first pin and the second pin with an opening provided at an other one of the transcribing portion base and the web guide portion base.

8. The printing apparatus according to claim 7, wherein the first pin has an outer diameter engageable with the opening and the second pin has an outer diameter engageable with the opening and has an outer diameter larger than the outer diameter of the first pin.

9. The printing apparatus according to claim 1, wherein the pivotable pin member is pivotable in a direction perpendicular to a longitudinal axis of the pivotable pin member, from one of the transcribing portion base and the web guide portion base to the other one of the transcribing portion base and the web guide portion base.

10. The printing apparatus according to claim 7, wherein the pivotable pin member is pivotable in a direction perpendicular to a longitudinal axis of the pivotable pin member, from one of the transcribing portion base and the web guide portion base to the other one of the transcribing portion base and the web guide portion base.

11. The printing apparatus according to claim 3, wherein the adjusting member includes a rotatable shaft rotatable about a longitudinal axis, wherein the first pin extends from the rotatable shaft in a first direction perpendicular to the longitudinal axis of the rotatable shaft, and wherein the second pin extends from the rotatable shaft in a second direction perpendicular to the longitudinal axis of the rotatable shaft different from the first direction.

12. The printing apparatus according to claim 8, wherein the adjusting member includes a rotatable shaft rotatable about a longitudinal axis, wherein the first pin extends from the rotatable shaft in a first direction perpendicular to the longitudinal axis of the rotatable shaft, and wherein the second pin extends from the rotatable shaft in a second direction perpendicular to the longitudinal axis of the rotatable shaft different from the first direction.

13. The printing apparatus according to claim 1, wherein longitudinal axes of the rotating shaft and the pivotable pin member intersect.

14. The printing apparatus according to claim 7, wherein longitudinal axes of the rotating shaft and the pivotable pin member intersect.

15. The printing apparatus according to claim 1, wherein longitudinal axes of the rotating shaft and the pivotable pin member are perpendicular to each other.

16. The printing apparatus according to claim 7, wherein longitudinal axes of the rotating shaft and the pivotable pin member are perpendicular to each other.

17. The printing apparatus according to claim 1, wherein said side face of the rotating shaft is parallel to a direction that the transcribing portion connects with the web guide portion such that said driver engages with said groove in a direction perpendicular to the direction that the transcribing portion connects with the web guide portion.

18. The printing apparatus according to claim 7, wherein said side face of the rotating shaft is parallel to a direction that the transcribing portion connects with the web guide portion such that said driver engages with said groove in a direction perpendicular to the direction that the transcribing portion connects with the web guide portion.

19. The printing apparatus according to claim 1, wherein the second pin has an outer diameter larger than an outer diameter of the first pin, said first pin and said second pin having a similar shape to engage with said opening.

20. The printing apparatus according to claim 7, wherein the second pin has an outer diameter larger than an outer diameter of the first pin, said first pin and said second pin having a similar shape to engage with said opening.

* * * * *